US008624095B2

(12) United States Patent
Pukalo

(10) Patent No.: US 8,624,095 B2
(45) Date of Patent: Jan. 7, 2014

(54) MUSICAL INSTRUMENT

(76) Inventor: Terry Pukalo, Winnipeg (CA)

( * ) Notice: Subject to any disclaimer, the term of this patent is extended or adjusted under 35 U.S.C. 154(b) by 293 days.

(21) Appl. No.: 13/117,635

(22) Filed: May 27, 2011

(65) Prior Publication Data

US 2012/0297953 A1 Nov. 29, 2012

(51) Int. Cl.
*G10D 3/00* (2006.01)

(52) U.S. Cl.
USPC ..... 84/291

(58) Field of Classification Search
USPC ..... 84/291
See application file for complete search history.

(56) References Cited

U.S. PATENT DOCUMENTS 1,828,315 A * 10/1931 Cavicchioli ..... 84/263
D239,973 S * 5/1976 Pelensky ..... D17/14
2012/0272807 A1* 11/2012 Erwin ..... 84/282

* cited by examiner

*Primary Examiner* — Jianchun Qin
(74) *Attorney, Agent, or Firm* — Adrian D. Battison; Ade & Company Inc.

(57) ABSTRACT

A musical instrument has an instrument body with a neck extending from the instrument body and including a finger board thereon and eight strings arranged to provide the sounds of a Violin, Viola and Cello. The strings cooperate with two separate bridges for supporting the strings and communicating the sounds to two compartments within the body. The strings connect with tuning pegs carried on a peg support mounted at the base of the body. The body is shaped and arranged to be carried in the manner of a guitar and to cooperate with a curved bow with a center handle.

17 Claims, 11 Drawing Sheets

MUSICAL INSTRUMENT

This invention relates to a musical instrument which provides a novel construction of two instruments and a novel manner of operation of those instruments.

SUMMARY OF THE INVENTION

It is one object of the invention to provide a novel musical instrument.

According to a first aspect of the invention there is provided a musical instrument comprising:

an instrument body having a front face, a rear face, a peripheral wall and a hollow interior;

a neck extending from the instrument body and including a finger board thereon;

a plurality of strings extending along the neck to the body arranged for bowing of the strings;

a bridge arrangement for supporting the strings;

a plurality of tuning pegs carried on a peg support, each peg being arranged for receiving and tensioning a respective one of the strings;

wherein there are at least eight strings musical instrument arranged to provide the sounds of a Violin and Cello.

According to a second aspect of the invention there is provided a musical instrument comprising:

an instrument body having a front face, a rear face, a peripheral wall and a hollow interior;

a neck extending from the instrument body and including a finger board thereon;

a plurality of strings extending along the neck to the body arranged for bowing of the strings;

a bridge arrangement for supporting the strings;

a plurality of tuning pegs carried on a peg support, each peg being arranged for receiving and tensioning a respective one of the strings;

wherein the body and neck are arranged to be held like a guitar;

wherein the instrument uses a bow with a curved surface for engaging the strings;

and wherein the bow has a handle by which the bow is grasped located at a central position thereon opposite the surface for contacting the strings.

According to a third aspect of the invention there is provided a musical instrument comprising:

an instrument body having a front face, a rear face, a peripheral wall and a hollow interior;

a neck extending from the instrument body and including a finger board thereon;

a plurality of strings extending along the neck to the body arranged for bowing of the strings;

a bridge arrangement for supporting the strings;

a plurality of tuning pegs carried on a peg support, each peg being arranged for receiving and tensioning a respective one of the strings;

wherein the body and neck are arranged to be held like a guitar;

and wherein the bridge arrangement comprises two separate bridges arranged at spaced positions along the strings.

The instrument described herein is an 8 stringed musical instrument which encompasses the abilities of these 3 instruments into a single instrument: Violin, Viola and Cello The body size ranges and can have up to approximately the same volume of a cello. It is held like a guitar. The instrument uses a special bow to agitate and vibrate the strings to make the sounds.

The instrument described herein is a single body, single neck instrument which varies in size depending upon the musician's preference. The instrument has 8 strings, 2 bridges and uses special pegs to tighten the strings in place. The strings are pinned rigidly in place at the end of the neck, and run nearly parallel to one another along the length of the neck towards the centre of the body. The strings crest at the bridge and angle down to the tuning/tightening pegs. The tuning/tightening pegs are nearer the centre of the instrument rather than the end of the neck.

The instrument is fastened to the body using a typical guitar strap and held similarly to a guitar. Special emphasis about exact location of bridges in regards to bowing was developed and implemented.

Material Used

The "classical" style of the instrument will be typically made of maple and spruce for the body, while the neck/fingerboard will be of ebony or another hard wood of similar consistency. The materials for the instrument will resemble the Violin/Viola/Cello to help mimic the sounds those classical instruments make.

The Neck

The instrument is held much like a guitar and contains a single neck which narrows to approximately half the width when it reaches half its length. It uses the longest portion of the neck (which is similar to the length of a cello) for the lowest sounding strings. It uses the shorter portion of the neck (which is similar in length to that of a violin) to play the higher sounding strings. The lowest sounding notes are played by common (or typical) cello strings. These notes on open strings are: C, G, D, A. The higher notes are played with elongated violin strings (custom sized) to play G, D, A, E. The viola range of notes is encompassed between these two ranges.

The finger positioning throughout the length of the neck will be consistent to those of the cello and violin, and fingering of the strings will mimic a cross technique between guitar and cello/violin/viola.

The neck/fingerboard of the instrument is rounded with the same diameter and shape arc as the bridges. This allows the bow to make contact with individual strings.

There are two separate bridges required for the instrument; each lifting up and aligning 4 strings. Each bridge (the violin-like and cello-like) are located different distances from the end of the neck which allows the length of playable string area to remain relatively consistent to that of the violin or cello.

The body of the instrument can contain roughly the same volume as that of a cello. One major difference between the instrument body and the cello body is that the Instrument body is internally sectioned off into two portions. One large interior portion mimics the volume of the cello, while the smaller interior portion mimics the volume of the violin. Each set of strings will resonate throughout their designated section of the body which will create the consistent sound of those instruments. The sound is transferred from the strings by two separate sets of sound pegs and bass bars.

The shape of the body is important to allow proper angles for bowing, and maintaining that the bowing is done in an "in-line and over the shoulder" manner. The shape of the Instrument, like the shape of the guitar body can and will be able to alter from instrument to instrument to suit the musician's visual aesthetic tastes. The emphasis on every style will still be on playability in those key elements involving bowing motions.

The instrument typically uses a special curved bow. The curved bow mimics the same function as a traditional violin, viola or cello bow. This function is to allow the player to use specific motions to draw or slide the designated surface of the bow across the strings to create the desired sounds of the instrument. The bow is necessarily curved as to help avoid hitting the musician's shoulder when fully extended in "up bow" position. The curve in the bow also helps to reduce the distance the musician must bow away from the body without reducing the length of playable surface length of the bow itself. Because typical horse hair cannot be pulled taut on a curved surface, this bow needs to use fabric to help generate the friction required to resonate the strings. The fabric (many different varieties can have the proper texture) will be fastened to the bow by use of "hook & loop" fabric. This will allow a used & frayed fabric length to be changed when the time is necessary.

The instrument uses 8 strings: 4 Cello strings & 4 elongated Violin strings. The instrument fingerboard has one length split into two unique portions to help the player easily play a wider range of notes than either Violin and Cello can do independently. The instrument neck/fingerboard is one solid piece of hardwood.

The instrument has 2 separate bridges creating two different length spans for the 8 strings. Both bridges are aligned to allow the natural arch for the strings.

The instrument has the tuning pegs located not on the end of the neck but rather upon the body of the instrument. The elongated Violin strings and the Cello strings are pinned on the end of the neck. This is opposite to those of the Cello and Violin.

The instrument is held in a fashion similarly to a guitar. The player uses a special curved bow to vibrate the strings. The bow motion and positioning has a location dependent upon the style of instrument being played.

The instrument has a body which is partitioned off within the interior.

The instrument requires unique hardware to make work: special curved bows (or bow handle attachments for typical Violin or Cello bows), special elongated Violin strings, precision machined tuning pegs.

The instrument provides a decorative head piece. Arbitrary and user selected; the head piece on Violins, Violas and Cellos are typically in a "scroll" shape.

The "Cello" neck end of the instrument is designed to house the bored holes to allow strings: "C, G, D, A" to pass through comfortably and naturally.

The instrument has dually bored holes designed to house and catch the "nut" end of the Cello strings.

The instrument has dually bored holes designed to house and catch the "nut" end of the elongated Violin strings.

The instrument has a rounded head piece which narrows out to ensure easy transition of player's hand up and down the neck of the instrument.

The instrument has a "Violin" neck end designed to house the bored holes to allow strings: "G,D,A,E" to pass through comfortably and naturally.

The instrument has Cello and elongated Violin strings which are spaced evenly and on a consistent arch to ensure playability by the bow.

The instrument has elongated Violin strings which follow the same angle as the Cello strings until they meet the "Violin" bridge. The Cello strings continue past to eventually reach the "Cello" bridge. This also helps ensure consistent arch and continuity to playing angle. This area between the neck/fingerboard and the "Violin" bridge is where the bow makes contact with the strings.

The neck of the instrument narrows near the head to allow the even spacing of Cello strings. Midway upon the instrument, the neck/fingerboard opens to allow the addition and even spacing of the elongated Violin strings.

Nearest the bridges is the widest portion of the neck/fingerboard. The spaces of strings continue to increase as the strings near the bridges.

The "Violin" bridge catches the highest pitched strings (elongated violin strings: G, D, A, E). The "Violin" bridge helps to transfer sound created by vibration of strings down to sound peg and bass bars. The "Violin" bridge is shorter and slimmer than "Cello" bridge and tapers out to help sustain balance.

The "Violin" bridge sound peg and bass bar helps to transfer sound vibrations from the bridge into the body cavity. "S" holes cut onto both sides of the top face of the instrument. These holes allow the release of sound from the "Violin" portion of the instrument.

The "Violin" cavity is created within a portion of the instrument closest to the neck/fingerboard. This cavity resembles approximately the volume of a typical Violin cavity.

The "Cello" cavity is created within a portion of the instrument furthest from the neck/fingerboard. This cavity can resemble approximately the volume of a typical Cello cavity depending upon the design of the instrument body chosen.

Partitions are created to ensure the sound from each set of 4 strings sounds akin to the original instruments.

The "Cello" bridge catches the lowest pitched strings (Cello strings: C, G, D, A). The "Cello" bridge helps to transfer sound created by vibration of strings down to sound peg and bass bar.

The "Cello" bridge is taller and thicker than "Violin" bridge and tapers out to help sustain balance.

The "Cello" bridge sound peg and bass bar helps to transfer sound vibrations from the bridge into body cavity.

The strings after the respective bridges begin tapering down to customized tuning pegs.

Holes are cut onto top face of the instrument and allow the release of sound from the "Cello" portion of the instrument. The opening size and location is important. But the shape can be selected for aesthetics.

The tuning peg board is raised above the top face of instrument and houses and braces customized tuning pegs for all 8 strings.

The customized tuning pegs resemble traditional Violin and Cello tuning pegs with the added feature of very small metal teeth and catching switch to help prevent the slippage the strings sometimes create. Because there are no "fine tuning" pegs available for this instrument, the special machined tuning pegs also help to serve the function of smaller, fine tunes upon the strings.

The interior framework also referred to as the spine serves to connect the neck/fingerboard to the body of the instrument. The interior spine helps to add rigidity and supporting structure to the tuning peg board and the cavity partitions.

The bow has a curved front face design which helps to prevent the player from striking their shoulder during "up bow" position.

Finger notches on the center handle of the bow are provided which allow easy and comfortable grip for the player to maintain with the bow. The center position of the hand hold of the bow can be changed depending upon the player's preference and body style.

The front playing surface of the bow has a special fabric adhered to the wood bow. This fabric will give the necessary friction to the strings to provide vibration of the strings. This fabric carries conventional rosin to ensure proper playing sound of the strings.

The instrument described herein can have one or more of the following advantages:

One instrument can play the range of 3 instruments: Violin, Viola & Cello. This allows the player a wider range of capability in their skills.

The instrument can be played while the musician is singing. With Violin and Viola this is hardly possible.

The instrument would appeal to the crowd that desires the guitar. More and more rock, alternative and pop bands are incorporating bowed string music; the musician would fit in better in a previously mentioned genre.

It is good to add new flare to classical instruments. There is nearly no different design styles within Violin, Violas or Cellos (acoustic versions) and the instrument described herein can offer numerous design styles.

A new instrument will draw attention towards the classical music genre that otherwise may not occur.

The instrument can create sounds unique only to this instrument. For example, double and triple stops are playing techniques for violin, viola and cello.

For these techniques the player will play 2 or 3 strings simultaneously. Using the present instrument, the player can play double and triple stops across the range of 2 instruments in a manner simply not possible with the previous individual instruments.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
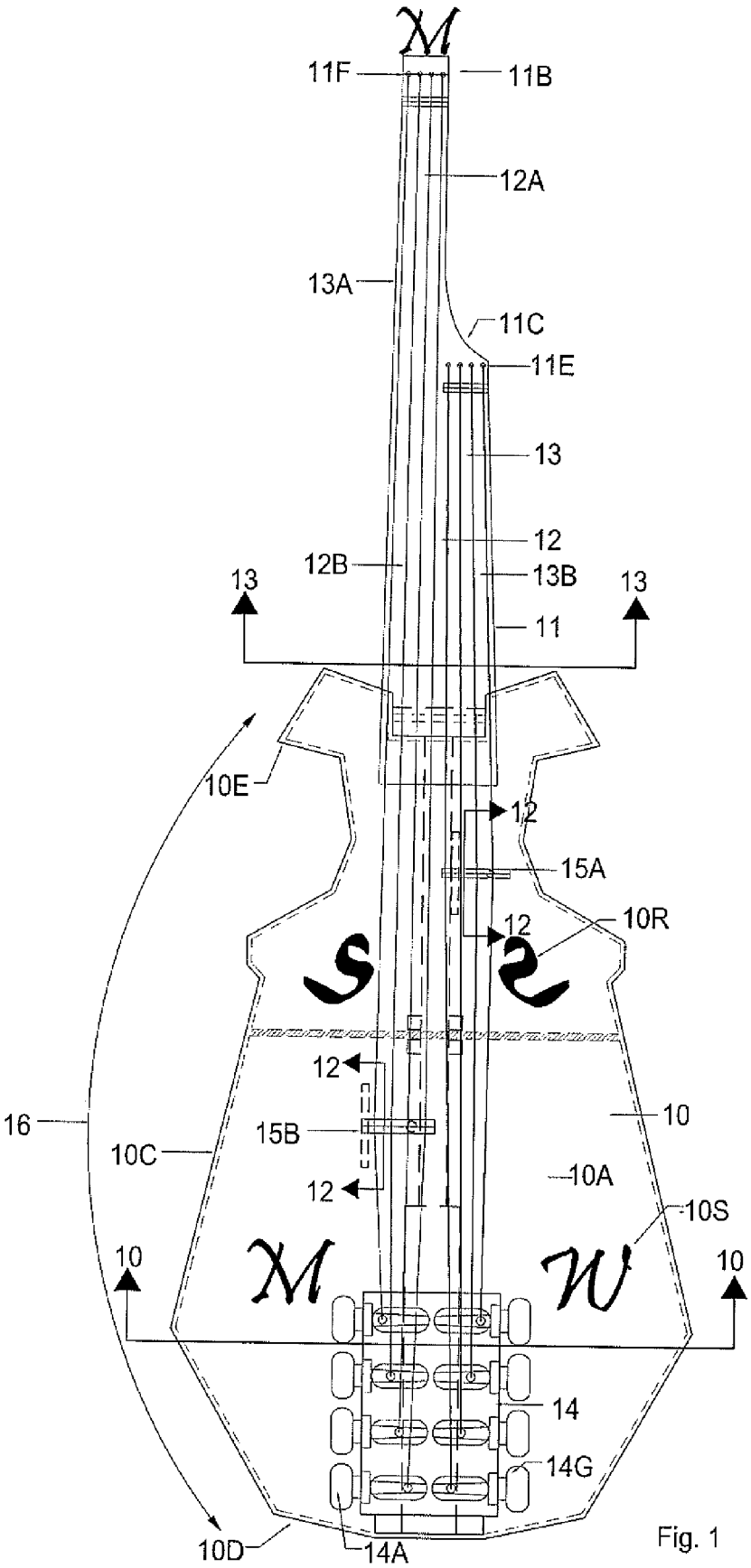
FIG. 1 is a front elevational view of an embodiment of musical instrument according to the present invention.
Figure 2:
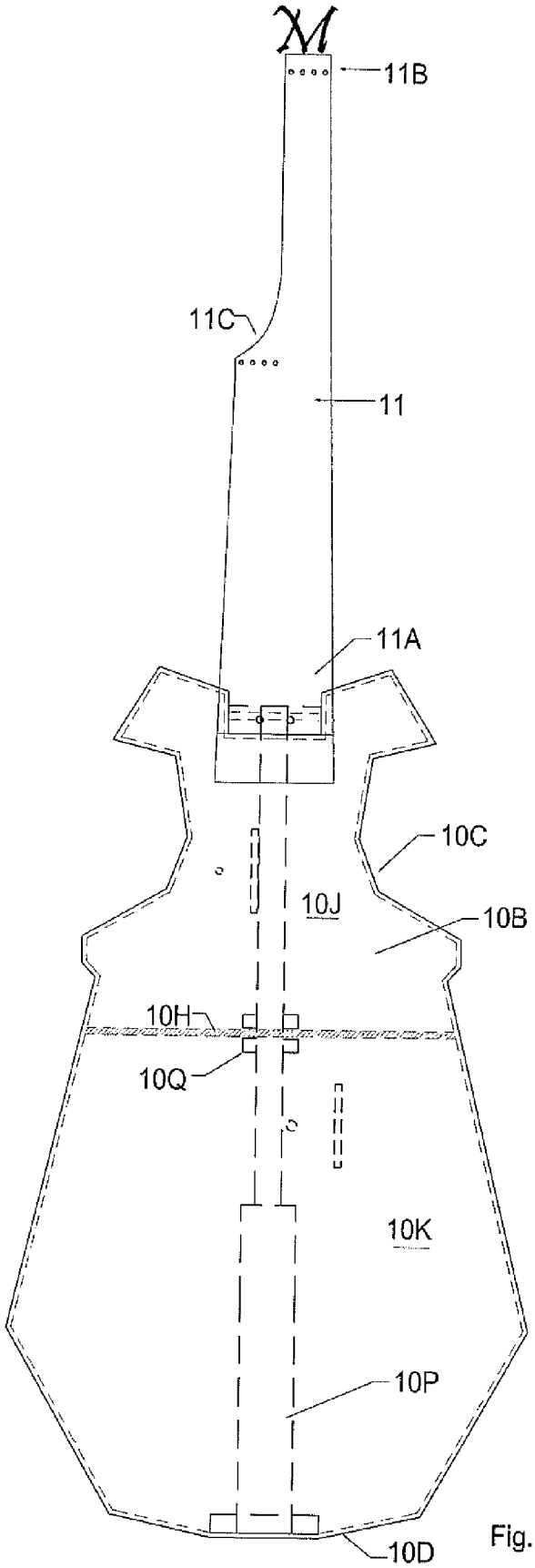
FIG. 2 is a front elevational view of the musical instrument of FIG. 1 with the strings and tuning peg support removed and showing the interior components in phantom.
Figure 3:
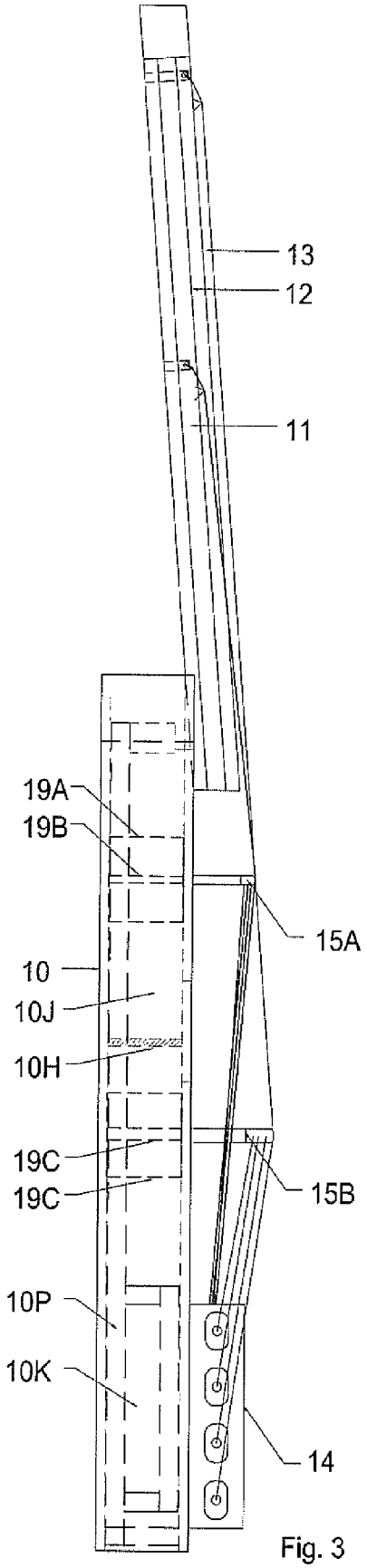
FIG. 3 is a side elevational view of the musical instrument of FIG. 1 showing the interior components in phantom.
Figure 4:
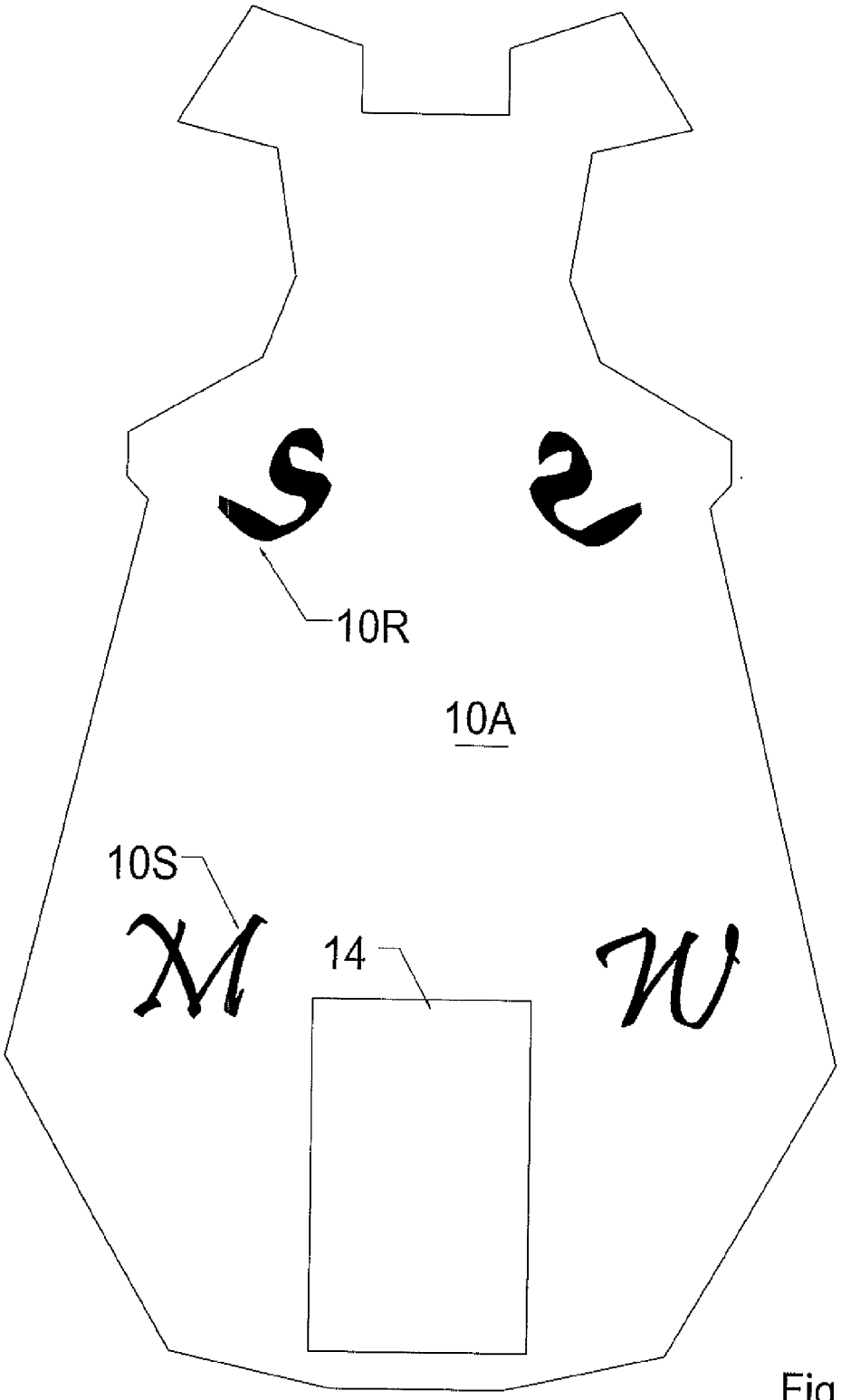
FIG. 4 is a front elevational view of the body only of the musical instrument of FIG. 1.
Figure 5:
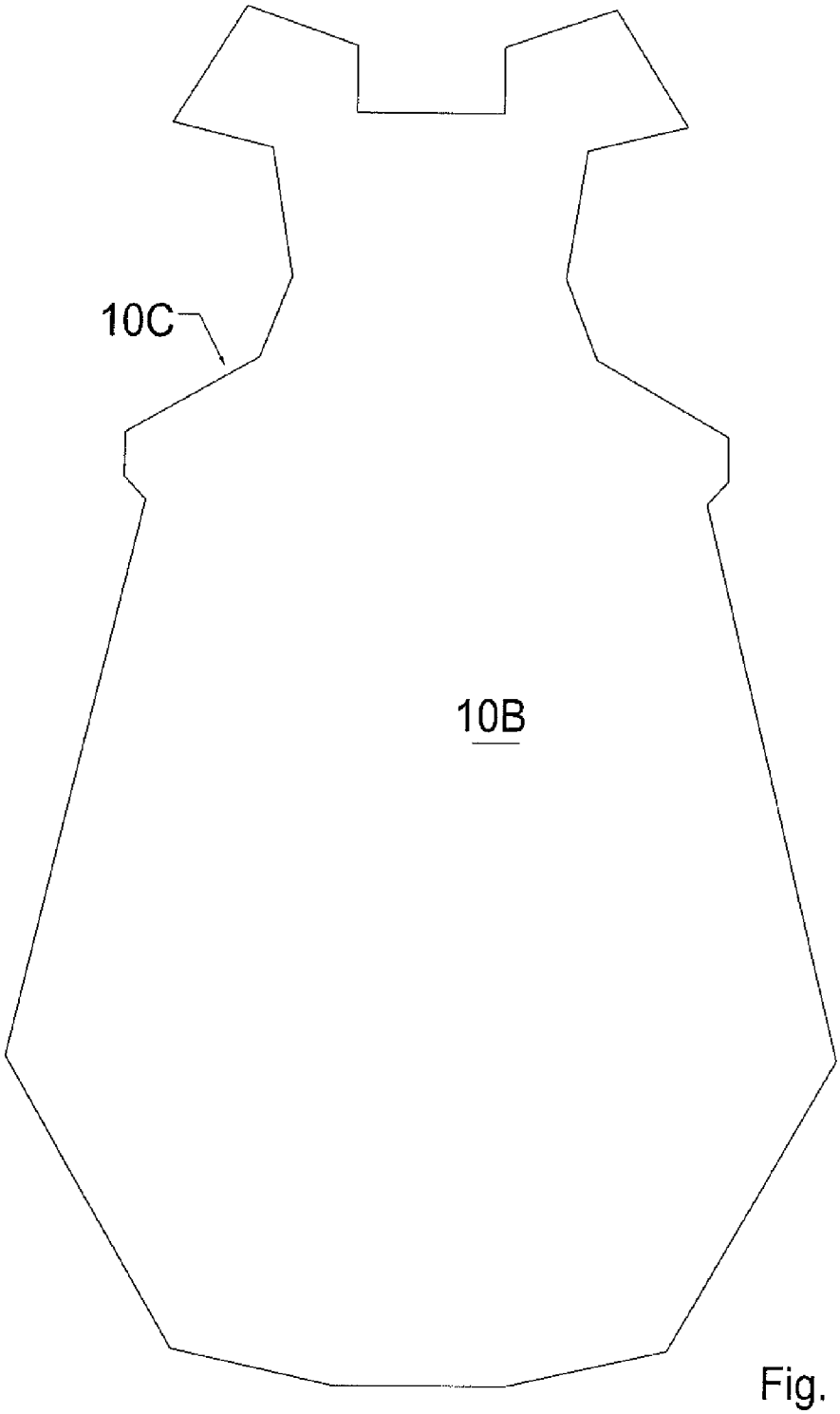
FIG. 5 is a rear elevational view of the body only of the musical instrument of FIG. 1.
Figure 6:
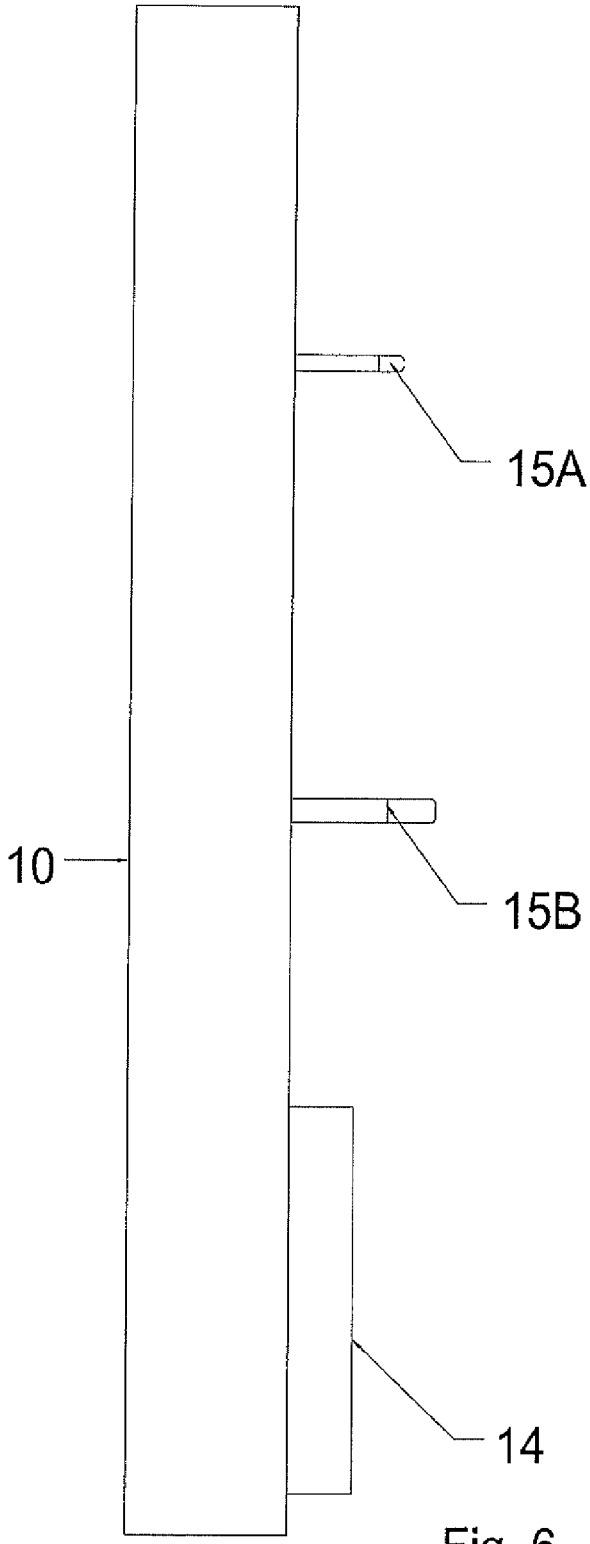
FIG. 6 is a side elevational view of the body only of the musical instrument of FIG. 1.
Figure 7:
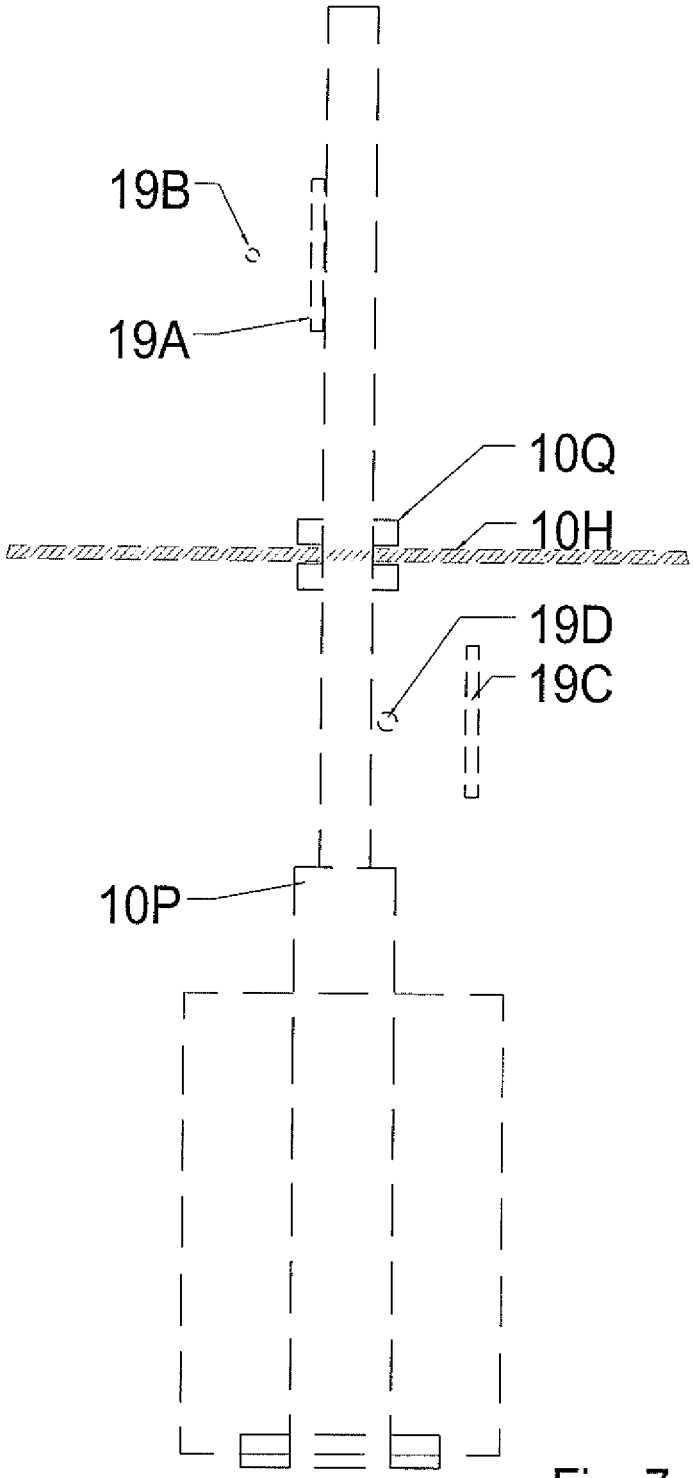
FIG. 7 is a front elevational view of the interior components only of the musical instrument of FIG. 1.
Figure 8:
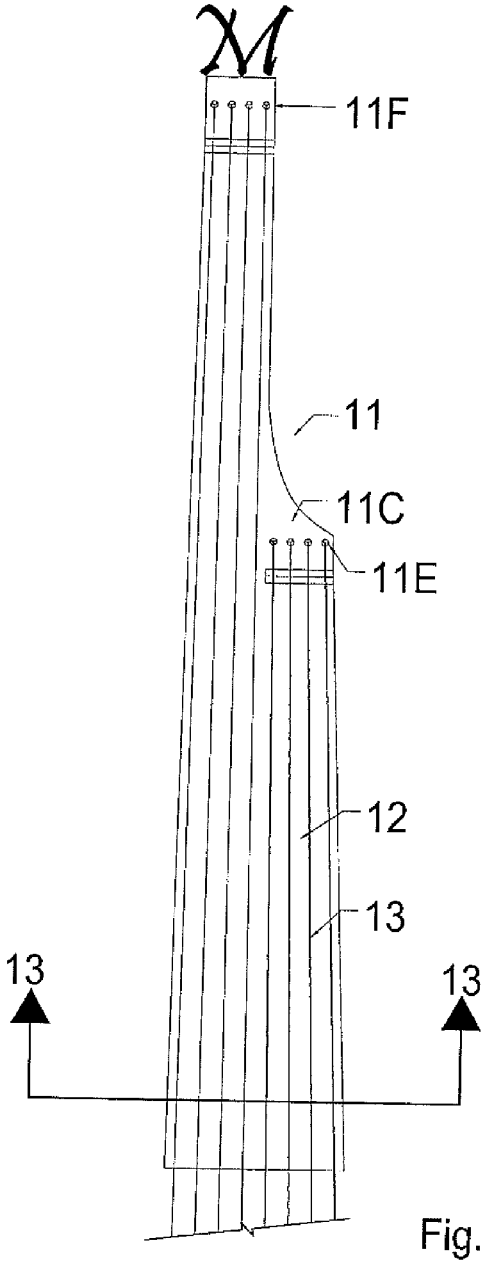
FIG. 8 is a front elevational view of the neck/fingerboard only of the musical instrument of FIG. 1.
Figure 9:
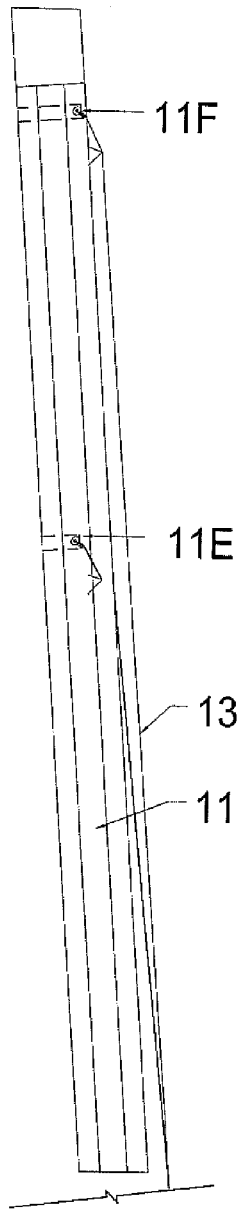
FIG. 9 is a side elevational view of the neck/fingerboard only of the musical instrument of FIG. 1.
Figure 10:
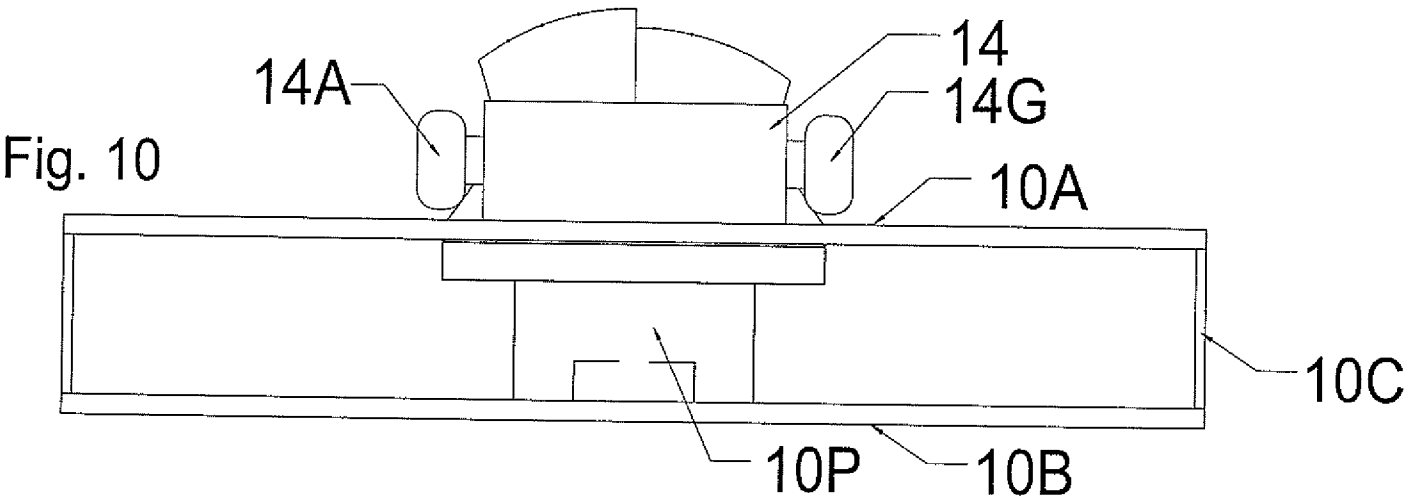
FIG. 10 is a cross-sectional view of the musical instrument taken along the lines 10-10 of FIG. 1.
Figure 12:
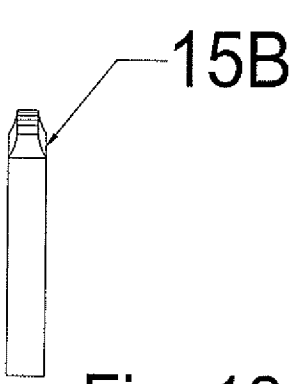
FIG. 12 is a side elevational view of the bridge arrangement only of the musical instrument of FIG. 1 taken along the lines 12-12 of FIG. 1.

The instrument described herein is an eight stringed musical instrument which encompasses the abilities of these three instruments into a single instrument: Violin, Viola and Cello. This comprises a body 10, a neck 11 carrying a finger board 12, a set of strings 13, a set of tuning pegs 14A to 14G on a tuning peg support 14, a bridge assembly 15 including separate bridge components 15A and 15B, and a strap 16 allowing the body to be carried on the style of a guitar over the shoulder.

The body 10 includes a front panel 10A, a rear panel 10B and a peripheral wall 10C together defining a size which has approximately the same volume as that of a cello. The strap 16 extends from one end at a base 10D of the body to an upper end 10E of the body allowing the body to be held like a guitar with the rear panel in front of the body of the player and the neck 11 extending outwardly to one side of the player.

The body as defined by the front and rear panels are is shaped in "classical" style and will be typically made of maple and spruce, while the neck/fingerboard will be of ebony or another hard wood of similar consistency. The materials for the instrument will resemble the Violin/Viola/Cello to help mimic the sounds those classical instruments make. The peripheral wall 10C follows the edges of the front and rear panels and can be made as a single strip or as separate pieces connected edge to edge in conventional manner.

The body of the instrument contains roughly the same volume as that of a cello. One major difference between the instrument body and the cello body is that the Instrument body is internally sectioned off by a transverse interior wall 10H at right angles to the neck into two portions 10J and 10K. One large interior portion 10K mimics the volume of the cello, while the smaller interior portion 10J mimics the volume of the violin. Each set of strings including the cello strings 13A and the violin strings 13B of the strings 13 resonate throughout their designated section 10K and 10J of the body which creates the consistent sound of those instruments. As is well known conventional violins and cellos include internally a bass bar, which is glued to the underside of the top of the instrument, and a round wooden sound post, which is wedged between the top and bottom plates. The bass bar 19A is located under the bass foot of the bridge 15A and serves to support the cello's top and distribute the vibrations. The sound post 19B, found under the treble side of the bridge, connects the back and front of the cello. Like the bridge, the sound post is not glued, but is kept in place by the tensions of the bridge and strings. Together, the bass bar and sound post transfer the strings' vibrations to the front panel of the instrument and to a lesser extent the rear panel, acting as a diaphragm to produce the instrument's sound. In the present instrument, the sound is transferred from the strings by two separate sets of sound pegs and bass bars indicated at 19A, 19B and 19C, 19D.

The shape of the body is important to allow proper angles for bowing, and maintaining that the bowing is done in an "in-line and over the shoulder" manner. The shape of the Instrument, like the shape of the guitar body can be altered from instrument to instrument to suit the musician's visual aesthetic tastes. The emphasis on every style will still be on playability in those key elements involving bowing motions.

The body includes an interior framework 10P also referred to as the spine which extends as a stiff bar along the rear panel from the base 10E to the bottom 11A of the neck and serves to connect the neck/fingerboard to the body of the instrument. The interior spine 10P helps to add rigidity and supporting structure to the tuning peg board and the cavity partition 10H to which it is connected by a bracket 10Q.

The instrument provides a decorative head piece 11B which is user selected and different from the head piece typical on Violins, Violas and Cellos which are typically in a "scroll" shape.

Holes 10R and 10S are cut onto top face of the instrument and are located in the small and large sections 10J and 10K respectively to allow the release of sound from the "Cello" portion of the instrument and from the violin portion. The opening size and location is important as in a conventional cello but the shape can be selected for aesthetics.

The neck 11 forms a single neck which varies in size depending upon the musician's preference. The strings 13 are pinned rigidly in place at the end 11B of the neck, and run nearly parallel to one another along the length of the neck towards the centre of the body 10. The strings 13 crest at the bridge elements 15A and 15B and angle down to the tuning/tightening pegs 14A to 14G on the support 14. The tuning/tightening pegs 14A to 14G are located on the support at the base 10D rather than the end of the neck.

The single neck 11 narrows to approximately half the width at a central position 11C at half its length. It uses the longest portion of the neck, which is similar to the length of a cello, for the lowest sounding strings. It uses the shorter portion of the neck, which is similar in length to that of a violin, to play the higher sounding strings. The lowest sounding notes are played by cello strings which are of the same length as a conventional cello. These notes on open strings are: C, G, D, A. The higher notes are played with elongated violin strings, which are longer than the conventional violin to play G, D, A, E. The viola range of notes is encompassed between these two ranges.

The finger positioning throughout the length of the neck is consistent to those of the cello and violin, and fingering of the strings mimics a cross technique between guitar and cello/violin/viola.

The neck/fingerboard 12 of the instrument is rounded in cross-section with the same shape arc as the bridges 15A and 15B. This allows the bow to make contact with individual strings.

The instrument fingerboard 12 has one length split into two unique portions 12A, 12B to help the player easily play a wider range of notes than either Violin and Cello can do independently. The instrument neck/fingerboard is one solid piece of hardwood. The instrument has a rounded head piece which narrows at the junction 11C out to ensure easy transition of player's hand up and down the neck of the instrument. The Violin neck end at 110 is designed to house the bored holes 11E to allow strings: "G,D,A,E" to pass through comfortably and naturally. The head end 11B contains bored holes 11F for the cello strings.

The elongated Violin strings follow the same angle as the Cello strings until they meet the Violin bridge 15A. The Cello strings continue past to eventually reach the Cello bridge 15B. This also helps ensure consistent arch and continuity to playing angle. This area between the neck/fingerboard 128 and the Violin bridge 15A is where the bow makes contact with the strings. Nearest the bridges is the widest portion of the neck/fingerboard 12. The spaces of strings continue to increase as the strings near the bridges 15A, 15B.

There are two separate bridges required for the instrument 15A and 15B; each lifting up and aligning four strings. The bridges 15A and 15B are located different distances from the end 11B of the neck 11 which allows the length of playable string area to remain relatively consistent to that of the violin or cello. Both bridges are aligned to allow the natural arch for the strings.

Figure 11:
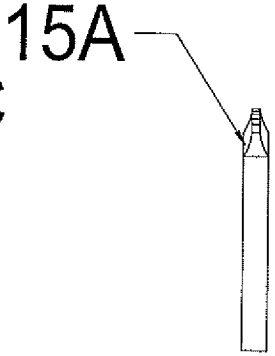
FIG. 11 is a rear elevational view of the bridge arrangement only of the musical instrument of FIG. 1.
Figure 11:
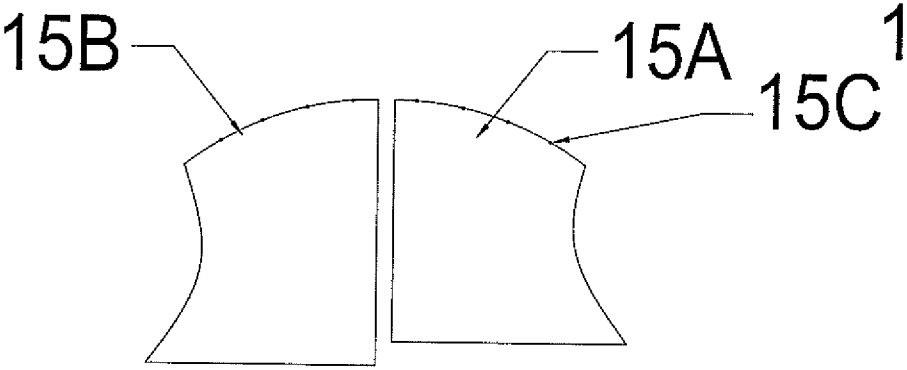
Figure 13:
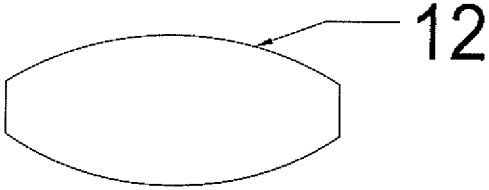
FIG. 13 is a cross-sectional view of the musical instrument taken along the lines 13-13 of FIG. 1.
Figures 14, 15:
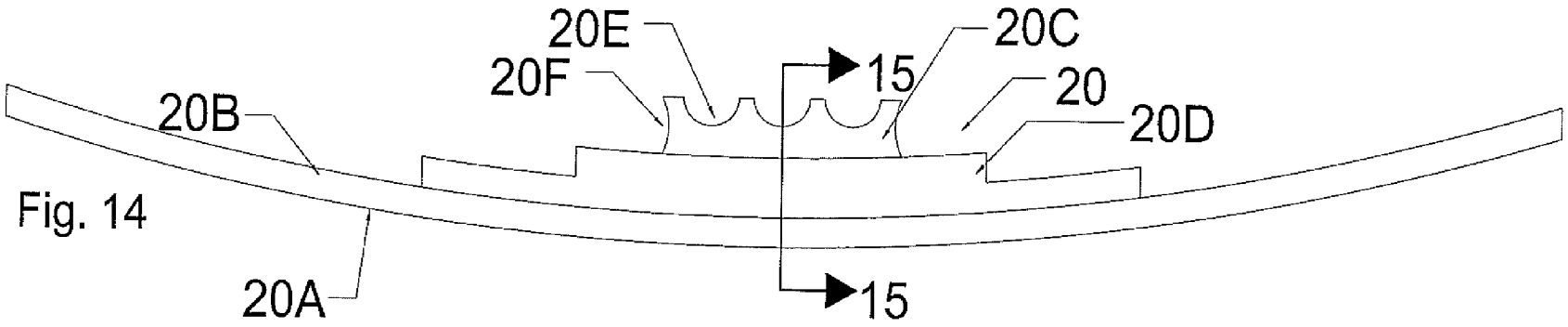
FIG. 14 is a front elevational view of a bow for the musical instrument of FIG. 1.
FIG. 15 is a cross-sectional view of the musical instrument taken along the lines 15-15 of FIG. 14.

As shown in FIG. 11, the two bridge sections 15A and 15B of the bridge arrangement have the string engaging surface thereof following the same arc 15C even though they are spaced longitudinally The Violin bridge 15A catches the highest pitched strings (elongated violin strings: G, D, A, E). The Violin bridge 15A helps to transfer sound created by vibration of strings down to sound peg and bass bars of the violin section in the chamber 10J. The Violin bridge 15A is shorter and slimmer or narrower in the direction of the strings than Cello bridge 15B and diverges outwardly in a direction transverse to the strings as shown in FIG. 11 at the bottom out to help sustain balance.

The Violin bridge 15A has the sound peg and bass bar arranged to transfer sound vibrations from the bridge into the body cavity. "S" holes 10R are cut onto both sides of the top face of the instrument. These holes allow the release of sound from the "Violin" portion of the instrument.

The Cello bridge 15B catches the lowest pitched strings (Cello strings: C, G, D, A). The "Cello" bridge helps to transfer sound created by vibration of strings down to sound peg and bass bar.

The "Cello" bridge sound peg and bass bar helps to transfer sound vibrations from the bridge into body cavity.

The instrument typically uses a special curved bow 20. The curved bow 20 performs the same function as a traditional violin, viola or cello bow but is shaped and arranged differently in view of the guitar type position of the instrument. This function is to allow the player to use specific motions to draw or slide the designated or lower surface 20A of the bow across the strings to create the desired sounds of the instrument. The bow surface is carried on a rigid bar 20B and is smoothly and convexly curved as to help avoid hitting the musician's shoulder when fully extended in "up bow" position. The curve in the bow also helps to reduce the distance the musician must bow away from the body without reducing the length of playable surface length of the bow itself. Because typical horse hair cannot be pulled taut on a curved surface, this bow uses a rosin coated fabric to generate the friction required to resonate the strings. The fabric can be of many different varieties to have the proper texture is fastened to the bow surface for example by a layer of "hook & loop" fabric. This will allow a used and frayed fabric length to be changed when the time is necessary.

The handle 20C is carried on a raised mount 20D and has three finger notches 20E on the upwardly facing surface and notches 20F at the ends for receiving the thumb and little finger. The center handle of the bow allows easy and comfortable grip for the player to maintain with the bow. The center position of the hand hold of the bow can be changed longitudinally by adjustment or by providing different bow types depending upon the player's preference and body style, in which case the handle is not directly at the center. However the handle is spaced from the end of the bow to allow bowing while in the guitar position.

The front playing surface of the bow has a special fabric adhered to the wood bow. This fabric will give the necessary friction to the strings to provide vibration of the strings. This fabric carries conventional rosin to ensure proper playing sound of the strings.

The instrument has the tuning pegs located not on the end of the neck but rather upon the body of the instrument on the support 14. The elongated Violin strings and the Cello strings are pinned on the end of the neck. This is opposite to those of the Cello and Violin.

The tuning peg support 14 is raised above the top face 10A of instrument and houses and braces customized tuning pegs for all eight strings. The customized tuning pegs resemble traditional Violin and Cello tuning pegs with the added feature of very small metal teeth and catching switch to help prevent the slippage the strings sometimes create. Because there are no "fine tuning" pegs available for this instrument, the special machined tuning pegs also help to serve the function of smaller, fine tunes upon the strings.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a Limiting sense.

The invention claimed is:

1. A musical instrument comprising:

an instrument body having a front face, a rear face, a peripheral wall and a hollow interior;

a neck extending from the instrument body and including a finger board thereon;

a plurality of side by side strings extending along the neck over the finger board of the neck for fingering thereon with the strings extending to the body so as to be arranged for bowing of all of the strings extending along the neck;

a plurality of tuning pegs arranged for receiving and tensioning a respective one of the strings;

wherein there are at least eight strings with a first set of four of the strings being arranged to provide the sounds of a Violin and a second set of four of the strings being arranged to provide the sounds of a Cello;

a first bridge associated with and supporting the first set of strings;

the first bridge being arched on an arc, when viewed longitudinally of the strings, so as to support the strings on the arc at different heights for bowing;

a second bridge associated with and supporting the second set of strings;

the second bridge being arched on an arc, when viewed longitudinally of the strings, so as to support the strings on the arc at different heights for bowing;

the first bridge being spaced from the second bridge longitudinally of the strings;

the first and second bridges, when viewed longitudinally of the strings, being arranged to lie on the same arc so as to support the first and second sets of the strings with the first set alongside the second set in the arc for bowing.

2. The instrument according to claim 1 wherein the body and neck are arranged to be held like a guitar.

3. The instrument according to claim 1 including a guitar strap attached to the body arranged to allow the body to be held similarly to a guitar.

4. The instrument according to claim 1 wherein there is a single neck which narrows to approximately half the width when it reaches approximately half its length.

5. The instrument according to claim 1 wherein the body of the instrument contains roughly the same volume as that of a cello.

6. The instrument according to claim 1 wherein the body is internally sectioned off into two portions.

7. The instrument according to claim 6 wherein the two portions include a larger interior portion which is approximately equal to the volume of a cello and a smaller interior portion is approximately equal to the volume of a violin and arranged such that each set of strings will resonate throughout the respective one of the two portions of the body.

8. The instrument according to claim 7 wherein the smaller interior portion of the body is located closer to the neck.

9. The instrument according to claim 1 wherein the second bridge for the cello strings is taller and thicker than the first bridge.

10. The instrument according to claim 1 wherein the tuning pegs are carried on a tuning peg support which is located upon the body of the instrument with the strings being pinned on the end of the neck.

11. The instrument according to claim 10 wherein the strings crest at the respective one of the first and second bridges and angle down to the tuning pegs.

12. The instrument according to claim 10 wherein the tuning peg support is raised above the top face of instrument.

13. The instrument according to claim 1 wherein there is provided an interior spine which acts to connect the neck to the instrument body.

14. A combination of a musical instrument and a bow for playing the musical instrument comprising:

a musical instrument comprising:

an instrument body having a front face, a rear face, a peripheral wall and a hollow interior;

a neck extending from the instrument body and including a finger board thereon;

a plurality of side by side strings extending along the neck over the finger board of the neck for fingering thereon with the strings extending to the body so as to be arranged for bowing of all of the strings extending along the neck;

a plurality of tuning pegs arranged for receiving and tensioning a respective one of the strings;

wherein there are at least eight strings with a first set of four of the strings being arranged to provide the sounds of a Violin and a second set of four of the strings being arranged to provide the sounds of a Cello;

a first bridge associated with and supporting the first set of strings;

the first bridge being arched on an arc, when viewed longitudinally of the strings, so as to support the strings on the arc at different heights for bowing;

a second bridge associated with and supporting the second set of strings;

the second bridge being arched on an arc, when viewed longitudinally of the strings, so as to support the strings on the arc at different heights for bowing;

the first bridge being spaced from the second bridge longitudinally of the strings;

the first and second bridges, when viewed longitudinally of the strings, being arranged to lie on the same arc so as to support the first and second sets of the strings with the first set alongside the second set in the arc for bowing;

and a bow for playing the instrument comprising:

a handle and a member having a surface extending longitudinal of the bow for engaging the strings;

wherein the surface is curved in a convex arch when viewed transverse to the bow and longitudinally of the strings as they are bowed.

15. The combination according to claim 14 wherein the bow uses fabric on the curved surface to generate the friction required to resonate the strings.

16. The combination according to claim 14 wherein the handle is located at a central position on the bow opposite the surface for contacting the strings.

17. The combination according to claim 14 wherein there is provided an interior spine which acts to connect the neck to the instrument body.

* * * * *